United States Patent [19]

Knudson

[11] Patent Number: 4,570,404

[45] Date of Patent: Feb. 18, 1986

[54] TWO-PART HOLD-DOWN APPARATUS WITH SLIP JOINT FOR SEAMED PANEL ASSEMBLIES

[76] Inventor: Gary A. Knudson, 17356 West 57th Ave., Golden, Colo. 80401

[21] Appl. No.: 472,586

[22] Filed: Mar. 7, 1983

[51] Int. Cl.[4] ..... E04D 1/00

[52] U.S. Cl. ..... 52/520; 52/573; 52/545; 52/530; 52/478

[58] Field of Search ..... 52/478, 544, 545, 547, 52/549, 528, 537, 542, 520, 573, 459, 463, 420, 488; 24/575, 576

[56] References Cited

U.S. PATENT DOCUMENTS

| | | | |
|---|---|---|---|
| 892,248 | 6/1908 | Garvin . | |
| 1,539,632 | 5/1925 | Belding | 52/530 |
| 1,882,105 | 10/1932 | Wender | 52/520 |
| 3,047,111 | 7/1962 | Clements et al. | 52/545 |
| 3,555,758 | 7/1969 | Schroter . | |
| 3,999,348 | 12/1976 | Hicks | 52/545 X |
| 4,034,532 | 7/1977 | Reinwall . | |
| 4,102,105 | 7/1978 | Taylor et al. . | |
| 4,337,606 | 7/1982 | Reusser | 52/573 |

FOREIGN PATENT DOCUMENTS

| | | | |
|---|---|---|---|
| 706575 | 3/1965 | Canada | 52/544 |
| 946261 | 7/1956 | Fed. Rep. of Germany | 52/483 |
| 494240 | 10/1938 | United Kingdom | 52/483 |

*Primary Examiner*—Carl D. Friedman
*Assistant Examiner*—Creighton H. Smith
*Attorney, Agent, or Firm*—Fields, Lewis, Pittenger & Rost

[57] ABSTRACT

A two-part hold-down apparatus for an assembly of seam-connected panels (11, 12) firmly secures the panels at the seam (13) to the supporting structure while at the same time allowing for thermal expansion and contraction movement thereof. An upper fastening member (31) has an upstanding web portion (32) with a top flange (33) extending out from an inner face that is firmly secured in a seam (13) joining the adjacent sidewall portions of two panels and extends down to the supporting surface. A bottom pocket (36) extends up from an outer face of the web portion and terminates in a top rim (37). A lower fastening member (41) covered by a panel (12) has a depending end section (44) freely slidable in the pocket and a top section (45) that bears against the rim to exert a hold-down pressure thereon to form a slide joint between the two members. A base (42) of the lower fastening member is firmly affixed to the supporting structure.

11 Claims, 8 Drawing Figures

TWO-PART HOLD-DOWN APPARATUS WITH SLIP JOINT FOR SEAMED PANEL ASSEMBLIES

TECHNICAL FIELD

This invention relates to novel and improved hold-down apparatus for firmly securing seam-connected panels to a supporting structure at the seams.

BACKGROUND ART

Seam-connected sheet metal panel assemblies have been used in many buildings to form roofs, walls, siding and the like. A variety of hold-down devices have been utilized to secure these panel assemblies to the supporting structure. The hold-down apparatus must take into account a considerably wide ambient temperature range to which the exposed metal panels are subjected.

Garvin U.S. Pat. No. 892,248 discloses sheet metal panel assemblies for roofing using angular sheet metal clips fastened in the interfitted edges between panels that bolt to the supporting structure.

Wender U.S. Pat. No. 1,882,105 discloses a two-part hold-down clinger with one part nailed to the supporting base and the other joined to the panels at the seam. A groove and rivet arrangement is provided between the two parts to permit contraction and expansion due to temperature changes.

Schroter U.S. Pat. No. 3,555,758 discloses a circular seam joining adjacent panels into which one end of a hold-down device is telescopically received, the other end being affixed to the supporting structure.

Reinwall U.S. Pat. No. 4,034,532 discloses a two-part hold-down clip assembly comprised of a clip and a foot. The clip has a slot in the upstanding web and the foot has a downturned hook that hooks into the slot to permit relative longitudinal movement of the panels in relation to the supporting structure.

Taylor U.S. Pat. No. 4,102,105 discloses a hold-down clip comprised of an upstanding body and a foot having an elongated slot. A U-shaped washer fits snugly on the foot so that the aperture is in alinement with the elongated slot. A screw is directed through the aperture to secure the clip to the supporting structure.

A product in commercial use sold by American Steel Components, Inc. has a two-part hold-down clip the upper member of which is not firmly secured to the seam. The lower member extends up from the inner face of the web portion and the pocket portion is closer to the upper seam than to the base on the supporting structure.

DISCLOSURE OF INVENTION

A two-part hold-down device for panel assemblies accommodates expansion and contraction of the panels when subjected to extreme temperature changes. An upper clip-like fastening member is firmly secured in the seam joining the sidewalls of adjacent panels and has a pocket portion that extends up from the bottom of the web portion between the panels at the bottom of the panels and terminates in a top rim. A lower clip-like fastening member has a depending end section that slides in the pocket and a top section that bears against the rim of the pocket portion to form a slip joint between the two fastening members with a base connected to the top section that is firmly secured to the supporting structure.

DETAILED DESCRIPTION

Figure 2:
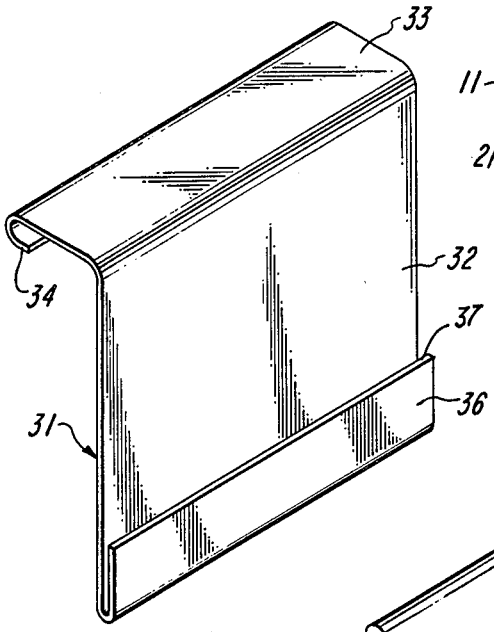
FIG. 2 is a perspective view of the upper fastening member of the hold-down apparatus.
Figure 1:
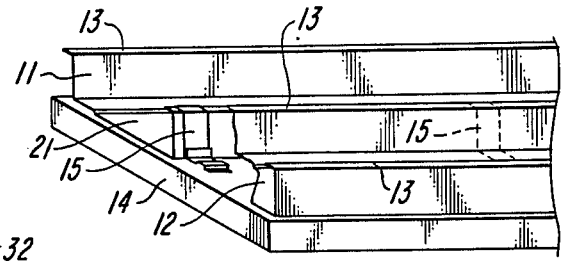
FIG. 1 is a perspective view of a panel assembly being secured to a supporting structure by hold-down apparatus embodying features of the present invention.

Referring now to the drawings, there are shown side by side identical metal panels designated 11 and 12 having interfitting side edge fastening portions joined at a continuous seam 13 to form a unitary panel assembly. The panel assembly is shown disposed on a supporting structure 14 and held to the supporting structure by hold-down apparatus 15 embodying features of the present invention located at spaced intervals along the seam. The details of the panels and seam are disclosed in applicant's U.S. Pat. No. 2,967,430.

Figure 4:
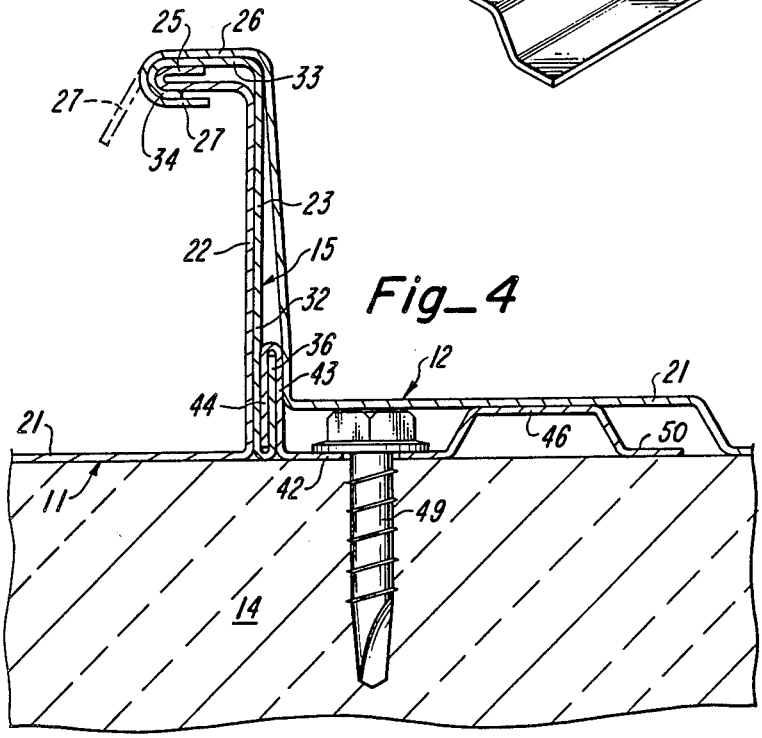
FIG. 4 is a vertical sectional view of the assembled hold-down apparatus.

As shown in FIG. 4, the panels 11 and 12 are identical and each has a bottom portion 21 and a pair of upright sidewall portions 22 and 23 extending up from opposite edges of the bottom portion. An inturned flange portion 25 extends laterally in from the upper edge of sidewall portion 22 at right angles thereto and an outturned flange portion 26 extends laterally out from the upper edge of sidewall portion 23 at right angles thereto.

The inturned flange portion 25 shown has a terminal section bent back over a portion of the lateral section to provide a reverse bend or fold and a double thickness. The outturned flange portion 26 is initially formed as an inverted channel into which the inturned flange portion 25 of the adjacent panel will easily insert and nest. The inverted channel has a depending terminal section 27 shown in dashed lines opposite and spaced from the associated sidewall portion which is folded back under the inturned flange portion 25 by seaming apparatus that travels along the panel flanges to connect the panels together as a unitary or integral structure and form a weathertight continuous seam.

The hold-down apparatus 15 shown is comprised of an upper fastening member 31 including an upstanding web portion 32. A top flange portion 33 extends laterally in from an inner face at the top of the web portion at right angles thereto. The inner face of the web portion faces panel 11. A hook 34 is bent back under the top flange portion 33 and hooks over the inturned flange portion 25 of the panel 11. An upwardly facing pocket portion 36 is formed along the outer face of the web portion at the bottom thereof. Pocket portion 36 has a top rim 37. The web portion is shown extending to the supporting surface and to the plane of the bottom of the panels 11 and 12.

Member 31 is preferably made of a single piece of galvanized steel that is bent to provide the above described portions. Member 31 is in the nature of a metal clip and is also referred to herein as a "clip-like member."

The hold-down apparatus 15 further includes a lower fastening member 41 having a depending end section 44 freely slidable in the pocket portion 36, a top section 45 in the form of a bend coupled over and bearing against the top rim 37, and an inside upright leg 43 forming an inverted deep channel that has a cross section similar in size and shape to that of the pocket 36.

Member 41 further has a base portion 42 including a flat lower section 47 adjacent a section 43, a flat raised section 46 extending beyond the lower section 47 on which the panel 12 is supported, and a lower end section 50. The raised section 46 provides a space for the heads of the fasteners 49. The lower section 47 as shown has three holes 48 and is secured to the underlying support structure by one or more bolt fasteners 49.

Member 41 preferably is made of a single piece of galvanized sheet steel that is bent to provide the above described portions or sections. Member 41 is in the nature of a metal clip and is also referred to herein as a "clip-like member."

By way of illustration, and not limitation, a typical hold-down device above described and an assembly of the panels with such devices connected thereto has the following dimensions:

| | | |
|---|---|---|
| Upper fastening member 31: | | |
| Width (along panels) | | 4" to 6" |
| Thickness | 24 gauge | 0.027" |
| Length of top flange 33 (laterally of panels) | | 0.5" |
| Inside gap of inverted channel | | 0.30" |
| Lower fastening member 41: | | |
| Width (along panels) | | 2.66" to 3" |
| Material thickness | 24 gauge | 0.27" |
| Overall length (laterally of panels) | | 1.8" |
| Inside gap of pocket portion 36 | | 0.30" |
| Spacing between hold-down devices (center to center) | | 4 feet |

A preferred sequence for assembling the hold-down apparatus 15 above described is to position panel 11 on the supporting structure 14. The upper fastening member 31 has its hook 34 hooked over the inturned flange portion 25 of panel 11 and its web portion 32 extends down along the outer face of the sidewall portion 22 of the panel. The end section 44 of lower fastening member 41 is inserted into the pocket portion 36 and then firmly fastened to the supporting structure by one or more of the bolt fasteners 49.

The next panel 12 has its outturned flange portion 26 nested over the top flange portion 33 and inturned flange portion 25. The terminal section 27 is seamed under the outturned flange portion to form a weathertight seam which firmly secures the top flange 25 to the panels. The procedure is then repeated for each adjacent panel. In practice there are a plurality of the hold-down apparatus in each seam.

In use, when the metal panels become hot or cold in response to the ambient air, the slip joint allows the upper fastening member to slide relative to the lower fastening member while the top section 45 applies hold-down forces to the top rim 37.

Figure 5:
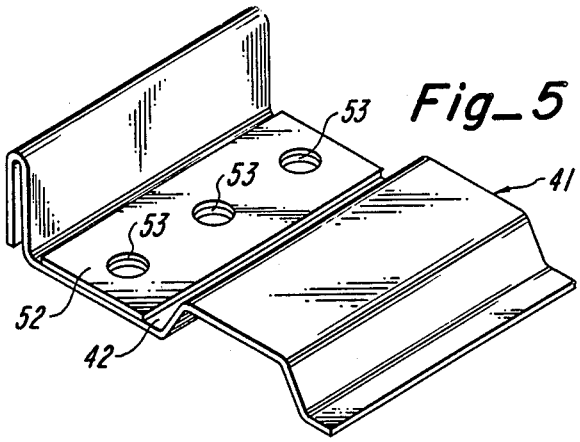
FIG. 5 is a perspective view of a washer suitable for use on the lower fastening member shown in FIG. 3.

The number of holes 48 for the number of fasteners used depends upon the particular strength requirements for a particular application. For maximum strength a rectangular washer 52 with three holes 53 is used on top of the lower section 50, as shown in FIG. 5, and three fastening bolts extend through the alined holes. The supporting structure 14 typically is a purlin. Seam 13 is commonly referred to as a standing seam.

Figure 6:
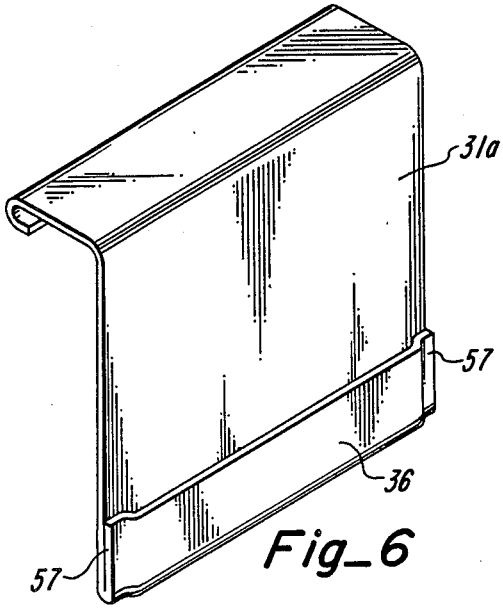
FIG. 6 is a perspective view of a modified form of upper fastening member.

A modified form of upper fastening member, shown in FIG. 6 and designated by numeral 13*a*, has the upturned end section forming the pocket closed by crimping or pinching, as indicated at 57, to limit the extent of movement of the upper fastening member in the lower fastening member. An alternative to the crimped or pinched arrangement shown is to close the ends of the pockets by a spot weld.

Figure 7:
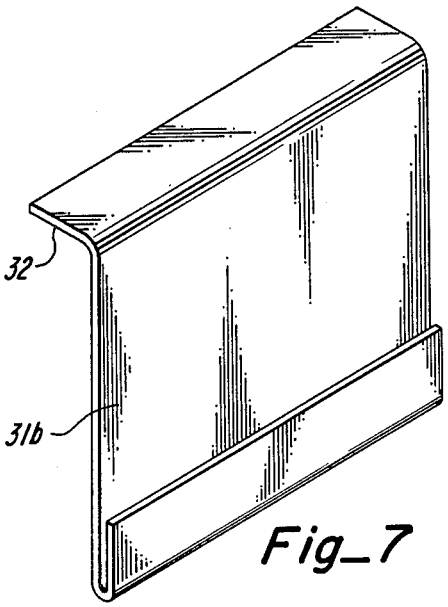
FIG. 7 is a perspective view of another modified form of upper fastening member.

A further modified form of the upper fastening member, shown in FIG. 7 and designated by numeral 31*b*, has the hook 34 removed so that the top flange section 33 terminates at the top of the upper fastening member. This construction may be used when a secure fastening is not required at the top of the assembled panels.

Figure 3:
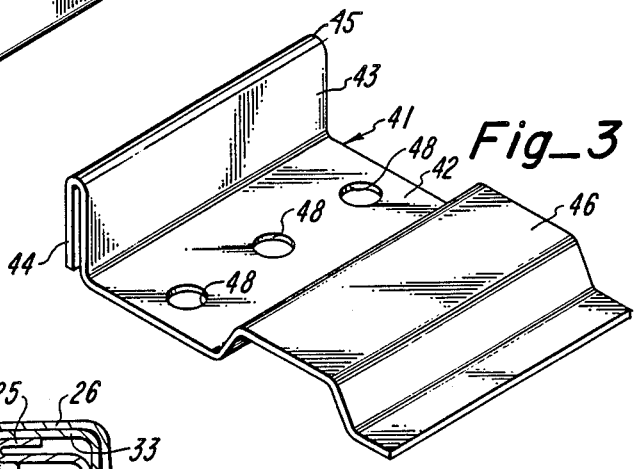
FIG. 3 is a perspective view of the lower member of the hold-down apparatus.
Figure 8:
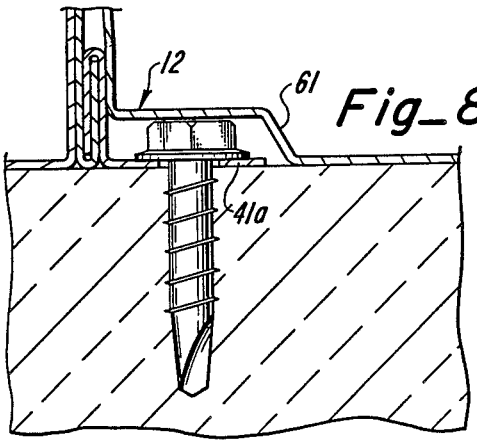
FIG. 8 is a vertical sectional view of a modified form of lower fastening member.

A modified form of lower fastening member 41*a*, shown in FIG. 8, has a shorter base with only the lower section and terminating at one end so as not to require the raised portion 46 or end section 50 shown in FIG. 3. In this form the panel 12 has its bottom wall folded down just beyond the fastener, as indicated at 61.

The above described hold-down apparatus 15 is completely hidden by the seamed panels. Moreover, the feature of having the web portion extend down to the bottom of the panels avoids any twisting tendencies in the slip joint.

Although the present invention has been described with a certain degree of particularity, it is understood that the present disclosure has been made by way of example and that changes in details of structure may be made without departing from the spirit thereof.

What is claimed is:

1. Hold-down apparatus for securing a panel assembly, including first and second side by side panels having adjacent sidewall portions joined by a seam, to a supporting structure while allowing relative longitudinal movement of said panel assembly relative to said supporting structure in response to forces produced by the thermal expansion and contraction of said panel assembly, said hold-down apparatus comprising:

a first fastening member including an upstanding web portion, a top flange portion extending laterally of an inner face of the web portion facing a first panel and firmly secured to the seam, the web portion extending down to substantially a supporting surface, and a pocket portion connected at the bottom of said web portion and extending upwardly along an outer face of said web portion for a portion of the vertical extent of said web portion, said pocket portion having a top rim; and a second fastening member including a depending end section slidable along said pocket portion, a top section cupped over and bearing against said top rim to apply hold-down forces thereto, a leg opposite said end section forming a relatively deep inverted channel to form a slip joint with said pocket portion, said pocket portion and inverted channel being similar in size and shape, and a base extending laterally away from said inverted channel and from said first panel, said base being affixed to said supporting surface, said base being covered by a second panel, said second panel having an outturned flange at the upper end of an associated sidewall portion overlying said top flange portion, said outturned flange having a terminal section bent under an inturned flange at the upper end of an associated sidewall portion of said first panel to seam in and thereby firmly secure said top flange portion between said inturned and outturned flanges.

2. Hold-down apparatus as set forth in claim 1 wherein said top flange portion has a hook formed in a lateral extremity that extends down and in and hooks over the inturned flange of said first panel.

3. Hold-down apparatus as set forth in claim 1 wherein said first fastening member has a greater dimension along said panels than said second fastening member and extends beyond both ends of said second fastening member to enable said second fastening member to move in either direction on said first fastening member.

4. Hold-down apparatus as set forth in claim 3 wherein end portions of said pocket portion are closed to limit the extent of travel of said second fastening member relative to said first fastening member.

5. Hold-down apparatus as set forth in claim 1 wherein said pocket portion is substantially deeper than it is wide.

6. Hold down-apparatus as set forth in claim 1 wherein said base has a lower section adjacent said web portion through which fasteners extend and a raised section extending beyond said lower section on which the second panel rests to provide a space for the heads of the fasteners that extend through said lower section.

7. Hold-down apparatus as set forth in claim 1 wherein said base has a reinforcing washer overlying said lower section for added strength.

8. Hold-down apparatus as set forth in claim 1 wherein each of said first and second fastening members is made of a single piece of sheet metal bent to provide the associated portions and sections.

9. Hold-down apparatus as set forth in claim 1 wherein said end section and top section of said second fastening member are connected to said base by a leg opposite said end section that forms a relatively deep inverted channel similar in size and cross section to said pocket portion.

10. Hold-down apparatus, including first and second side by side panels having adjacent sidewall portions joined by a standing seam, for securing a panel assembly to a supporting structure while allowing relative longitudinal movement of said panel assembly relative to said supporting structure in response to forces produced by the thermal expansion and contraction of said panel assembly, said hold-down apparatus comprising:

a first clip-like fastening member including an upstanding web portion, a top flange portion extending laterally of an inner face of the web portion facing a first panel and firmly secured to the seam and extending down to substantially a supporting portion for a portion of the vertical extent of said web portion, said pocket portion having a top rim; and a second fastening member including a depending end section slidable along said pocket portion, a top section cupped over and bearing against said top rim to apply hold-down forces thereto, a leg opposite said end section forming a relatively deep inverted channel to form a slip joint with said pocket portion, said pocket portion and inverted channel being similar in size and shape, and a base extending laterally away from said inverted channel and from said first panel, said base being affixed to said supporting surface, said base being covered by a second panel, said second panel having an outturned flange at the upper end of an associated sidewall portion overlying said top flange portion, said outturned flange having a terminal section bent under an inturned flange at the upper end of an associated sidewall portion of said first panel to seam in and thereby firmly secure said top flange portion between said inturned and outturned flanges.

11. A panel assembly secured to a supporting structure by hold-down apparatus located at spaced intervals along said panel assembly for allowing relative longitudinal movement between said panel assembly and said supporting structure in response to forces produced by thermal expansion and contraction of said panel assembly, said panel assembly including first and second side by side panels joined at a standing seam, each said panel having a bottom wall portion and an upstanding sidewall portion along each side of said bottom wall portion, each hold-down apparatus comprising:

a first clip-like fastening member including an upstanding web portion extending along the outside of a sidewall portion of said first panel disposed on the supporting structure, a top flange portion extending laterally of an inner face of the web portion facing said first panel and extending over an inturned flange extending from the top of the sidewall portion of said first panel, and an upwardly facing pocket portion connected at the bottom of said web portion and extending upwardly along an outer face of said web portion for a portion of the vertical extent of said web portion, said pocket portion having a top rim, said web portion extending to substantially the bottom of said first panel; and a second clip-like fastening member including a downwardly facing, relatively deep channel similar in size and shape to said pocket portion, said channel having an end section inserted into said pocket to be freely slidable along said pocket portion, a top section and a leg section opposite said end section, said second fastening member having a base extending from a lower edge of said leg extending laterally away from said first fastening member and secured to the underlying supporting structure, said base being covered by said second panel, said second panel having an outturned flange at the upper end of an associated sidewall portion overlying said top flange portion, said outturned flange having a terminal section bent under said inturned flange portion to seam in said top flange portion of said first fastening member between said flange portions of said connected panels.

* * * * *